United States Patent [19]

Martin

[11] Patent Number: 4,771,945

[45] Date of Patent: Sep. 20, 1988

[54] DECONTAMINATION APPARATUS AND METHOD

[75] Inventor: Peter D. Martin, St Louis County, Mo.

[73] Assignee: Engineered Air Systems, Inc., St. Louis, Mo.

[21] Appl. No.: 33,678

[22] Filed: Apr. 3, 1987

[51] Int. Cl.[4] ..... B05B 1/24

[52] U.S. Cl. ..... 239/13; 239/127; 239/135

[58] Field of Search ..... 239/135, 124, 126, 127, 239/13, 1; 137/340; 417/199 A

[56] References Cited

U.S. PATENT DOCUMENTS

| | | | |
|---|---|---|---|
| 2,263,913 | 11/1941 | Bargeboer | 239/124 |
| 2,290,350 | 7/1942 | Olches | 239/124 |
| 2,795,873 | 6/1957 | Hoffman | 417/199 A |
| 2,980,339 | 4/1961 | Bok et al. | 239/135 |
| 4,061,271 | 12/1977 | Kimbrough | 239/127 |
| 4,066,386 | 1/1978 | Johnson et al. | 417/199 A |

FOREIGN PATENT DOCUMENTS

| | | | |
|---|---|---|---|
| 0071869 | 6/1979 | Japan | 239/124 |

*Primary Examiner*—Andres Kashnikow
*Assistant Examiner*—Karen B. Merritt
*Attorney, Agent, or Firm*—Ralph B. Brick

[57] ABSTRACT

A method and apparatus for preparing a decontamination fluid including passing the fluid from a supply source to a low pressurization zone prior to heating the fluid, heating at least a portion of the low pressurized fluid and passing the heated fluid to a high pressurization zone prior to introducing the heated fluid to the decontamination zone.

16 Claims, 1 Drawing Sheet

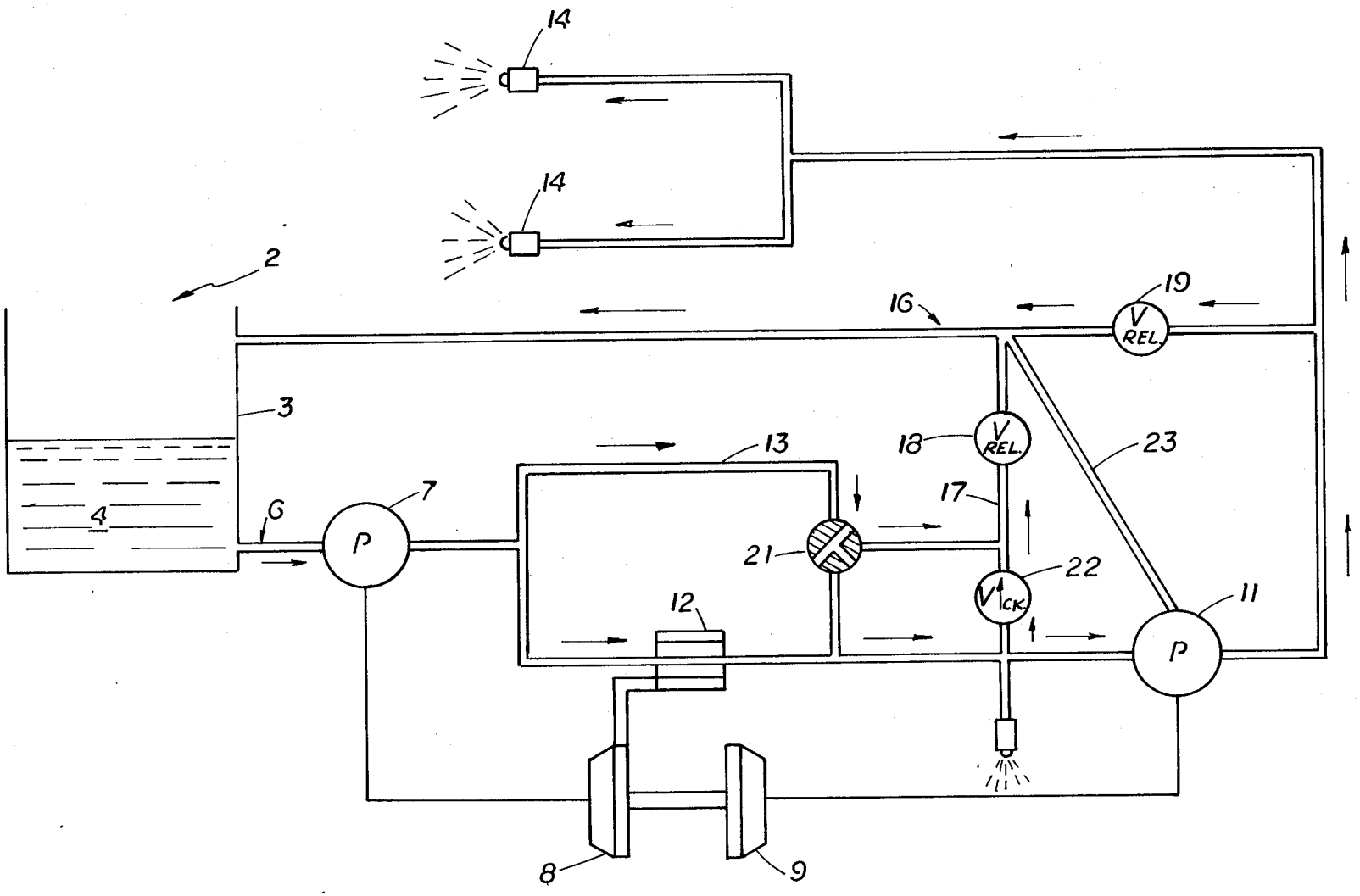
2
3
4
6
7
P
8
9
12
13
14
14
16
17
18
19
V REL.
21
22
V CK.
23
V REL.
11
P

DECONTAMINATION APPARATUS AND METHOD

BACKGROUND OF THE INVENTION

The present invention relates to a fluid decontamination apparatus and method of operating a fluid decontamination system and more particularly to a unique decontamination apparatus and method wherein decontamination fluid is pressurized to a first level, at least a portion of the pressurized fluid is heated and the fluid is then further pressurized to a second level before it is passed to a decontamination zone.

It is known in the prior art to introduce heated decontamination fluids under pressure into a decontaminating zone, attention being directed to the long since expired U.S. Pat. Nos. 1,124,289, issued to T. P. Burke on Jan. 12, 1915 and No. 1,743,245 issued to T. C. Smith on Jan. 14, 1930. It also is known to supply decontamination liquids from a static source under pressure to a spray zone, attention being directed to U.S. Pat. No. 4,516,726, issued to Karl H. Hoie on May 14, 1985. The present invention recognizes that these past arrangements frequently have produced serious safety and corrosion problems, requiring extensive heating systems with the heated fluids under high pressures often fouling the fluid conducting and heating equipment, resulting in equipment breakdown and concomitant safety problems. Recognizing the difficulties of past decontamination arrangements, the present invention provides a unique and novel apparatus for decontamination which is straightforward, economical and efficient in construction, operation and maintenance, which employs a minimum of uncomplicated parts and yet effectively and efficiently utilizes the power and heat of an existing power system in a straightforward, efficient and economical manner.

Various other features of the present invention will become obvious to one skilled in the art upon reading the disclosure set forth herein.

BRIEF SUMMARY OF THE INVENTION

More particularly, the present invention provides an improved method for preparing a decontamination fluid comprising: feeding the decontamination fluid from a supply zone to a low range pressurization zone; passing at least a portion of the fluid after low range pressurization to a heat exchange zone to raise the fluid temperature to a preselected level; feeding the heated fluid under low range pressurization to a high range pressurization zone; and passing the heated, highly pressurized fluid to a fluid decontamination spreading zone. In addition, the present invention provides a unique, novel decontamination apparatus comprising: a decontamination fluid supply source; fluid decontamination spreading means; a fluid conduit system connecting the supply source to the decontamination spreading means; a first pump means in the conduit system to pressurize the fluid to a preselected low pressure and move the low pressurized fluid at a preselected volume rate per minute; a heat exchanger in the conduit system downstream of the first pump means to regulate the temperature of at least a portion of the fluid; and a second pump means in the conduit system downstream of the heat exchanger to pressurize the fluid to a higher pressure and move the pressurized fluid at a preselected volume rate to the decontamination spreading means.

It is to be understood that various changes can be made by one skilled in the art in the several steps of the method and the several parts of the apparatus disclosed herein without departing from the scope or spirit of the invention.

BRIEF DESCRIPTION OF THE DRAWING

The drawing serves to schematically disclose an advantageous embodiment of the novel decontamination apparatus and method of the present invention in block form.

DETAILED DESCRIPTION OF THE DRAWING

Referring to the drawing, a fluid supply source 2 which can be in the form of a liquid tank or reservoir 3 for storing a static supply of decontamination liquid 4 is shown having its lower portion connected to a main liquid conduit system 6. Disposed in liquid conduit system immediately downstream tank 3 is a low pressure pump 7 which can obtain its power from gas turbine engine 8 which can further serve to drive compressor 9 and high pressure pump 11, which high pressure pump 11 also is included in main liquid conduit system 6.

Positioned between low pressure pump 7 and high pressure pump 11 in main liquid conduit system 6 is a heat exchanger 12, the heat exchanger 12 being arranged to receive heated exhaust gases from gas turbine engine 8 or alternative combustion device to heat the fluid or liquid in main conduit system 6. Main conduit system 6 is provided with a by-pass conduit 13 which serves to by-pass a preselected portion of the fluid in system 6 around heat exchanger 12 before the entirety of the low pressurized fluid is further pressurized by high pressure pump 11. The highly pressurized fluid is moved in main liquid conduit system 6 from high pressure pump 11 to the fluid decontamination spreader in the form of spray wands 14, two of such spray wands being disclosed on the same header in the drawing.

It is to be noted that a return conduit assembly 16 is provided to extend between main liquid conduit system and the upper portion of liquid reservoir 3. In this regard, a further by-pass conduit 17 around high pressure pump 11 extends between main liquid supply system 6 and return conduit 16. Pump by-pass conduit 17 is provided with a suitable low pressure relief valve 18 to assure that liquid above a predetermined low pressure is recirculated to reservoir 3. In like fashion, return conduit 16 is provided with a suitable high pressure relief valve 19 to assure that liquid above a predetermined high pressure is recirculated to reservoir 3. To prevent back-flow of liquid, a three-way adjustable bypass valve 21 and a check valve 22 are provided in heat exchanger by-pass conduit 13 and high pressure pump by-pass conduit 17. It is to be noted that a bleed conduit 23 is provided between high pressure pump 11 and return conduit 16 to allow aeration of the decontamination liquid prior to passage of the liquid to spray wands 14.

In carrying out the inventive method of the present invention, fluid which can be in liquid form is fed from a supply zone such as static liquid tank 3 along main conduit system 6 to a low pressurization zone which can be in the form of low pressure pump 7 that receives its power from gas turbine engine 8. Advantageously, the liquid fluid is pressurized to a low pressure range of approximately 5 to 20 psi. A portion of approximately 25% to 50% of the liquid is then moved to a heat exchange zone to raise the temperature of the liquid in a range of approximately 50° to 210° F. with the remainder of the liquid being by-passed around the heat exchange zone. As aforenoted, the heat exchange zone can include a heat exchanger 12, receiving its heat in the form of exhaust from gas turbine engine 8. The heated and by-passed liquid below 20 psi is then moved to a high pressurization zone at the rate of 15 to 20 gallons per minute. This high pressurization zone can be in the form of high pressure pump 11 which like pump 7 also can be powered by the power system in the form of gas turbine engine 8. In this high pressurization zone, the liquid is advantageously raised to a pressure level in the range of approximately 850 to 1,250 psi. At this high pressure level, the liquid is then passed to a high pressure spray decontamination zone at the rate of 5 to 10 gallons per minute for decontamination of equipment under high pressure.

It is to be noted that in the method aforedescribed, that those liquids above the abovedescribed sequential low and high pressure ranges are returned or recycled to the supply zone. It also is to be noted that some of the liquid at the low pressure range, either in heated or unheated form or both, can be utilized for other purposes than high pressure decontamination, such as for showering purposes.

From the above it can be readily seen that a straightforward, efficient and economical method and apparatus is provided which permits high pressurization of decontamination fluids at preselected temperature ranges without past safety and wear problems and without requiring a separate power system.

The invention claimed is:

1. A method of preparing a decontamination fluid comprising:

feeding said decontamination fluid from a supply zone to a low range pressurization zone;

passing at least a portion of said fluid after low range pressurization to a heat exchange zone to raise the temperature of said fluid to a preselected temperature level;

feeding said heated fluid under low range pressurization at a first preselected pressure level to a high range pressurization zone, certain of said fluid being returned to said supply zone after passing through said low range pressurization zone and before reaching said high range pressurization zone when in excess of said first preselected pressure level; and passing said heated fluid under high range pressurization at a second preselected level to a fluid decontamination spreading zone, certain of said fluid being returned to said supply zone after passing through said high range pressurization zone and before reaching said fluid decontamination zone when in excess of said second preselected pressure level.

2. The method of claim 1, wherein said low range pressurization zone pressurizes the fluid to the range of approximately 5 psi to 20 psi.

3. The method of claim 1, wherein said high range pressurization zone pressurizes the fluid to the range of approximately 850 psi to 1,250 psi.

4. The method of claim 1, wherein at least a portion of said fluid is by-passed around said heat exchange zone.

5. The method of claim 1, wherein approximately 50 to 75% of the fluid is by-passed around said heat exchange zone.

6. The method of claim 1, wherein said fluid is heated in said heat exchange zone to a temperature in the range of approximately 50° F. to 210° F.

7. The method of claim 1, wherein said fluid is passed through high pressure spray guns in said decontamination zone.

8. The method of claim 1, wherein said fluid is a liquid moved from said low pressurization zone at the rate of approximately 15 to 20 gallons per minute.

9. The method of claim 1, wherein said fluid is a liquid moved from said high pressurization zone at the rate of approximately 5 to 10 gallons per minute.

10. The method of claim 1, wherein said fluid is a liquid which is gas bled to a location above said supply zone prior to introduction into said decontamination zone.

11. A method of preparing a decontamination liquid in a power system comprising:

feeding said liquid from a static supply zone to a low pressurization zone powered by said system to pressurize said liquid to a low pressure range of approximately 5 to 20 psi and to move a portion of approximately 25% to 50% of said liquid at such pressure range to a heat exchange zone to raise the temperature of such portion to a temperature range between 50° F. to 210° F. with the remainder of such liquid by-passing said heat exchange zone;

passing said heated and by-passed liquid below 20 psi to a high pressurization zone powered by said system at a rate of 15 to 20 gallons per minute to raise said liquid to a high pressure of 850 to 1,250 psi with that liquid in excess of said low pressure range being returned to said supply zone before reaching said high pressurization zone and passing said highly pressurized liquid below 1,250 psi at the rate of 5 to 10 gallons per minute to a spray decontamination zone with that liquid in excess of said high pressure range being returned to said supply zone before reaching said spray decontamination zone.

12. A fluid decontamination apparatus comprising:

a fluid supply source to furnish a supply of decontamination fluid;

a fluid decontamination spreading means;

a fluid conduit system connecting said supply source to said decontamination spreading means;

a first pump means in said conduit system to pressurize said fluid to a preselected low pressure and to move said low pressurized fluid at a preselected volume rate per minute;

a heat exchanger in said conduit system downstream of said first pump means to regulate the temperature of at least a portion of said fluid to a preselected temperature; and a second pump means in said conduit system downstream of said heat exchanger to pressurize said fluid to a preselected high pressure to move said high pressurized fluid at a preselected volume rate per minute to said fluid decontamination spreading means; and, a return conduit system to said supply source downstream of said first and second pump means including pressure relief valves to maintain fluid below preselected pressure levels after each pump means.

13. The decontamination assembly of claim 12, and a by-pass conduit to allow a portion of said fluid to be by-passed around said heat exchanger.

14. The decontamination assembly of claim 12 and a bleed hose extending between said second pump means and said return conduit system, said return conduit system being connected to said fluid supply source at a position above the liquid level therein to allow aeration of said decontamination liquid.

15. A liquid decontamination system in a power assembly comprising:

a power means;

a liquid supply reservoir for storing a static supply of decontamination liquid;

liquid spray decontaminating means;

a liquid conduit system connecting the lower portion of said supply reservoir to said spray decontaminating means;

a low pressure pump in said conduit system driven by said power means to pressurize said liquid to a preselected low pressure and move a volume of said low pressurized liquid at a preselected rate in said liquid conduit system;

a heat exchanger downstream of said low pressure pump communicatively connected to the heated exhaust system of said power means to regulate the temperature of at least a portion of said liquid to a preselected temperature;

a by-pass conduit in said liquid conduit system to by-pass the remainder of the liquid from said low pressure pump around said heat exchanger;

a high pressure pump in said conduit system driven by said power means to further pressurize said heated liquid to a preselected high pressure and move a volume of said high pressurized and heated liquid at a preselected rate to said liquid spray decontamination means; and a liquid return conduit assembly in said liquid conduit system connected downstream of said low and high pressure pumps and returning to the upper portion of said supply reservoir, said return conduit assembly including pressure relief and check values to maintain the liquid below preselected pressure levels after each of said low and high pressure pumps.

16. The liquid decontamination system of claim 10, and a bleed conduit extending between said high pressure pump and said return conduit assembly to allow aeration of the decontamination liquid prior to passage to said liquid spray decontamination means, said return conduit assembly being connected to said liquid supply reservoir at a position above the liquid level therein to allów aeration of said decontamination liquid.

* * * * *